US012180707B2

(12) United States Patent
Steinburg et al.

(10) Patent No.: US 12,180,707 B2
(45) Date of Patent: Dec. 31, 2024

(54) SERVICE ACCESS FLOOR PANEL

(71) Applicant: TATE ACCESS FLOORS, INC., Jessup, MD (US)

(72) Inventors: Benjamin Lee Steinburg, Baltimore, MD (US); Daniel Kennedy, Lovettsville, VA (US); Gwen Demosky, Ellicott City, MD (US); Daniel Catalfu, Red Lion, PA (US); Santosh Dhakal, Hanover, MD (US)

(73) Assignee: TATE ACCESS FLOORS, INC., Jessup, MD (US)

( * ) Notice: Subject to any disclaimer, the term of this patent is extended or adjusted under 35 U.S.C. 154(b) by 177 days.

(21) Appl. No.: 17/881,005

(22) Filed: Aug. 4, 2022

(65) Prior Publication Data

US 2024/0044134 A1 Feb. 8, 2024

(51) Int. Cl.
*E04D 13/18* (2018.01)
*E04B 5/43* (2006.01)

(52) U.S. Cl.
CPC ..... *E04B 5/43* (2013.01)

(58) Field of Classification Search
CPC ..... E04B 5/43
See application file for complete search history.

(56) References Cited

U.S. PATENT DOCUMENTS 3,057,271 A * 10/1962 Butler ..... E04C 2/427 52/666
4,529,833 A * 7/1985 Weis ..... H02G 3/185 52/220.4
RE33,220 E * 5/1990 Collier ..... E04F 15/02452 52/263
5,257,487 A * 11/1993 Bantz ..... H02G 3/283 220/3.6
5,357,875 A * 10/1994 Winebarger ..... B65D 19/0024 108/51.3
5,675,949 A * 10/1997 Forslund ..... H02G 3/285 52/239
5,958,538 A * 9/1999 Kessler ..... A47L 23/24 52/177
7,075,005 B1 * 7/2006 Drane ..... H02G 3/185 174/53
8,153,910 B1 * 4/2012 Penczak ..... H02G 3/185 29/897.3
8,387,312 B1 * 3/2013 Murrey ..... E04B 5/43 52/263
8,519,276 B2 * 8/2013 Isaacks ..... H02G 3/185 70/387

(Continued)

*Primary Examiner* — Basil S Katcheves
(74) *Attorney, Agent, or Firm* — Oliff PLC

(57) ABSTRACT

An access floor panel that includes a base and a top plate on top of the base in a thickness direction of the access floor panel. The base includes at least one elongated slot having (1) a depth in the thickness direction, (2) a longitudinal axis in a first direction perpendicular to the thickness direction and (3) a slot opening in the top of the base in the thickness direction. The top plate has an elongated opening that is aligned with the slot opening of the at least one slot. The base and the top plate are configured such that a fastener assembly is received through the slot opening of the base and the elongated opening of top plate and retained within the slot to attach a structure to the access floor panel.

16 Claims, 11 Drawing Sheets

(56) References Cited

U.S. PATENT DOCUMENTS

| | | | | |
|---|---|---|---|---|
| 9,027,290 | B2 * | 5/2015 | Sippola | A61H 3/066 52/177 |
| 9,035,201 | B2 * | 5/2015 | Jones | H02G 3/185 174/487 |
| 9,887,527 | B2 * | 2/2018 | Scanzillo | H05K 5/03 |
| 10,544,576 | B2 * | 1/2020 | Ismert | E03F 5/0401 |
| 10,718,090 | B2 * | 7/2020 | van Raam | A01K 1/0151 |
| D900,346 | S * | 10/2020 | Rosan | D25/138 |
| 2002/0174608 | A1 * | 11/2002 | Rapisarda | F24F 3/167 52/167.1 |
| 2004/0216250 | A1 * | 11/2004 | Dumlao | B63B 5/00 14/73 |
| 2006/0265992 | A1 * | 11/2006 | Hiragaki | E04B 5/43 52/633 |
| 2007/0137129 | A1 * | 6/2007 | Sondermann | E04F 19/065 52/395 |
| 2010/0251646 | A1 * | 10/2010 | MacLean | E04B 5/02 52/302.1 |
| 2011/0067175 | A1 * | 3/2011 | Steylaerts | E03F 5/0408 4/679 |
| 2011/0088348 | A1 * | 4/2011 | Rahimzadeh | E04B 5/43 52/653.2 |
| 2017/0159294 | A1 * | 6/2017 | Sanabra Loewe | E04B 1/48 |
| 2018/0320333 | A1 * | 11/2018 | Fierlafijn | E04B 5/36 |
| 2019/0010695 | A1 * | 1/2019 | Zavitz | E04C 3/293 |
| 2021/0047789 | A1 * | 2/2021 | Easter | E01C 13/02 |
| 2021/0369004 | A1 * | 12/2021 | Iveson | B65D 25/06 |

* cited by examiner

30

SERVICE ACCESS FLOOR PANEL

FIELD OF THE INVENTION

This invention relates to raised floor panels, also called access floor panels. In particular, this invention relates to the interface between (i) access floor panels and (ii) equipment, apparatuses and structure that are supported by the access floor panels, such as, for example, in data centers, cabinets housing or otherwise supporting computers and other IT equipment, framework to support cable trays, air conditioning ductwork and aisle containment systems that may include components such as side wall panels, door assemblies and ceiling assemblies.

BACKGROUND OF THE INVENTION

Raised or access floor systems are used in many environments, including clean rooms and data centers. Raised or access floor systems are usually comprised of a continuous array of access floor panels, arranged edge-to-edge, and supported above a sub-floor by support members, such as pedestals. The lower ends of the pedestals rest on the subfloor. The access floor panels are placed on the top ends of the pedestals, and, in some applications, attached to those top ends. The array of access floor panels usually extends wall-to-wall in the room or area of the building in which the panels are installed.

A large variety of equipment, structures and apparatuses can be supported by the access floor assemblies in different applications. For example, in data centers, access floor systems may support cabinets for computers and other IT equipment and framework to support cable trays, air conditioning ductwork and hot aisle/cold aisle containment systems that include side panels, door assemblies, end panels, and ceilings.

Sometimes that equipment, that structure and those apparatuses are simply placed on the top surface of the access floor panels of access floor systems, depending on the types of equipment, structure and apparatuses and the parameters of the facilities housing the access floor system, equipment, structures and apparatuses. In other applications, the equipment, structures and apparatuses may also be anchored to the sub-floor through the access floor system. Examples of the latter applications include instances in which the equipment, structure and apparatuses are too heavy to be supported by the access floor system alone or when there are stringent seismic requirements for the facility.

In applications in which the access floor system can adequately support the equipment, structure and apparatuses, it is sometimes desirable to more firmly secure such equipment, structure and apparatuses to the individual access floor panels, for example, to meet certain seismic standards. In addition, it is beneficial for the equipment, structure and apparatuses to be relatively easily movable relative to the access floor systems because configurations of data centers and clean rooms, for example, are sometimes changed due to technological advances or other reasons.

Accordingly, there is a need in the access floor art for means to attach equipment, structures and apparatuses of a facility that includes an access floor system to the access floor panels that, at the least, is secure, sound, easy to connect and disconnect and meets seismic standards.

The access floor panels of this invention address those needs, as well as other needs that are readily apparent to those skilled in the art.

SUMMARY OF THE INVENTION

The access floor panels of some embodiments of this invention include a base and a top plate on top of the base in a thickness direction of the access floor panel. The base may include at least one slot having (1) a depth in the thickness direction, (2) a longitudinal axis in a first direction perpendicular to the thickness direction and (3) a slot opening in a top of the base in the thickness direction. The top plate may have at least one top plate elongated opening that is aligned with the slot opening of the base. The base and the top plate may be configured such that a fastener assembly can be received through the slot opening in the base and the top plate elongated opening and received and engaged by the base in the at least one slot to attach a structure to the access floor panel.

In some embodiments of this invention, the base of the access floor panel may include two spaced and parallel slots.

In other embodiments of this invention, each of the slots in the base may be defined by a member with (1) a bottom wall in the thickness direction, (2) a pair of elongated, spaced and parallel side walls that extend from opposite edges of the bottom wall toward the slot opening in the thickness direction and (3) inwardly extending portions at the top of each of the pair of side walls. Innermost edges of the inwardly extending portions may define the slot openings. The inwardly extending portions may also be configured to engage and retain the fastener assembly.

In yet other embodiments of this invention, the inwardly extending portions may be hook-shaped with the curved free end of the hook facing downward in the thickness direction. The free end of the hook may be configured to engage a top surface of a nut of the fastener assembly.

DETAILED DESCRIPTION OF FIGURES

Figure 1:
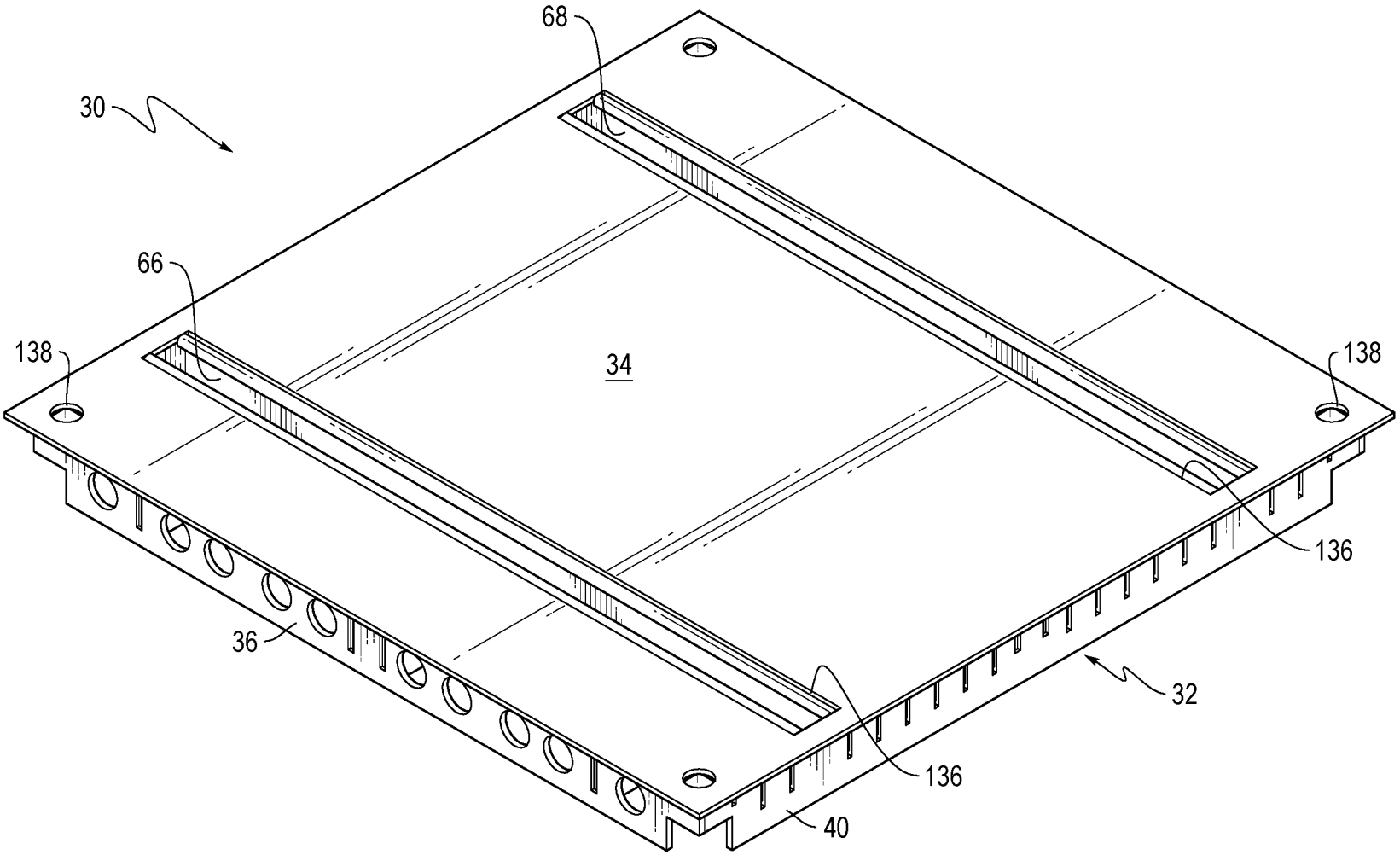
FIG. 1 is a top perspective view of an access floor panel of one embodiment of this invention.
Figure 2:
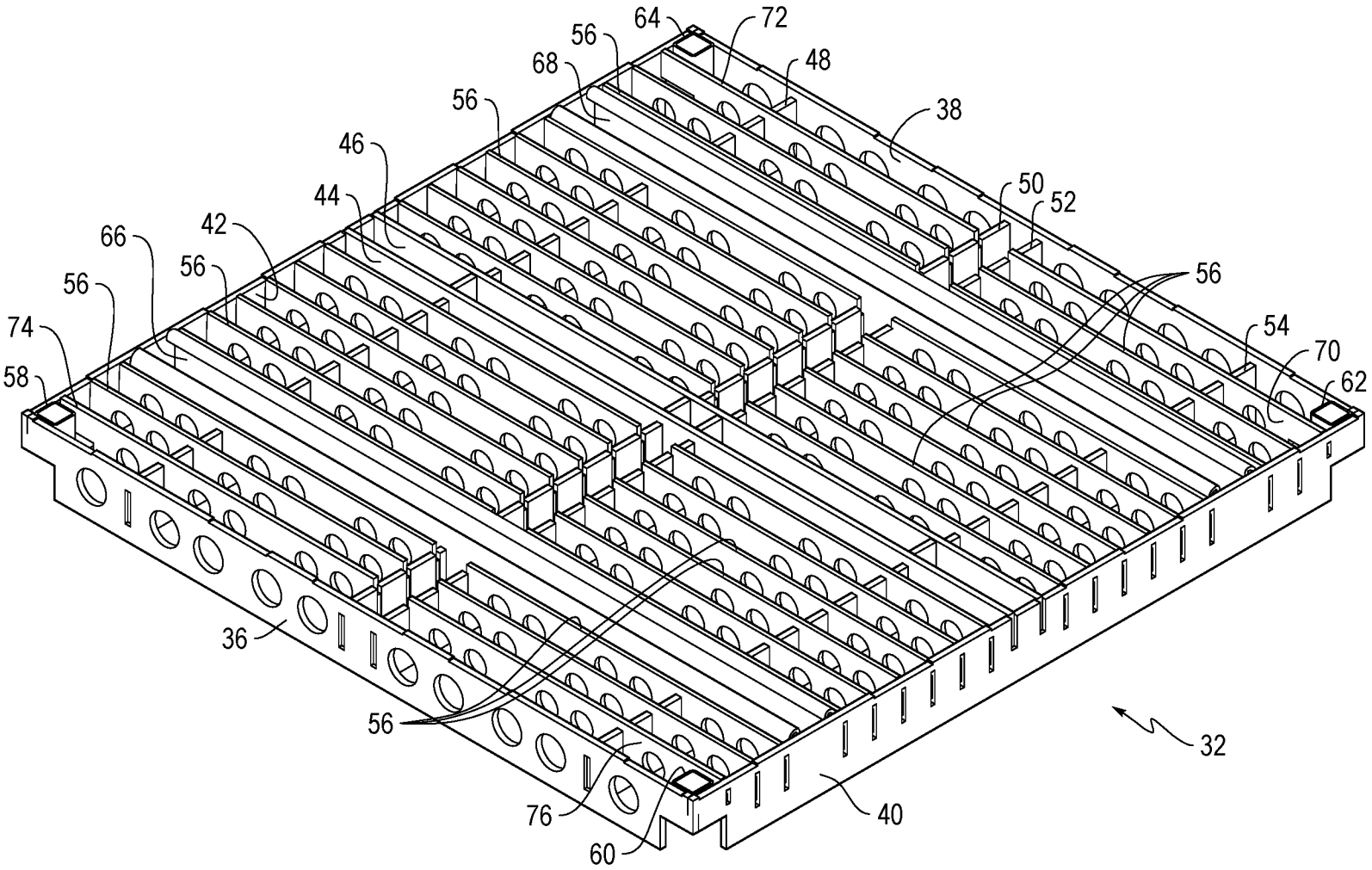
FIG. 2 is a top perspective view of the access floor panel of the embodiment of this invention illustrated in FIG. 1 with its top sheet removed.

As stated, an access floor panel of one embodiment of this invention is illustrated in the figures, access floor panel 30. Access floor panel 30 includes base 32 and top sheet 34.

In this embodiment of the invention, base 32 includes end support panels 36 and 38, side support panels 40 and 42, intermediate support vanes 44 and 46, intermediate support vanes 48, 50, 52 and 54, fin supports 56, fin supports 70, 72, 74 and 76, corner tubes 58, 60, 62 and 64 and channel members 66 and 68.

Figure 6:
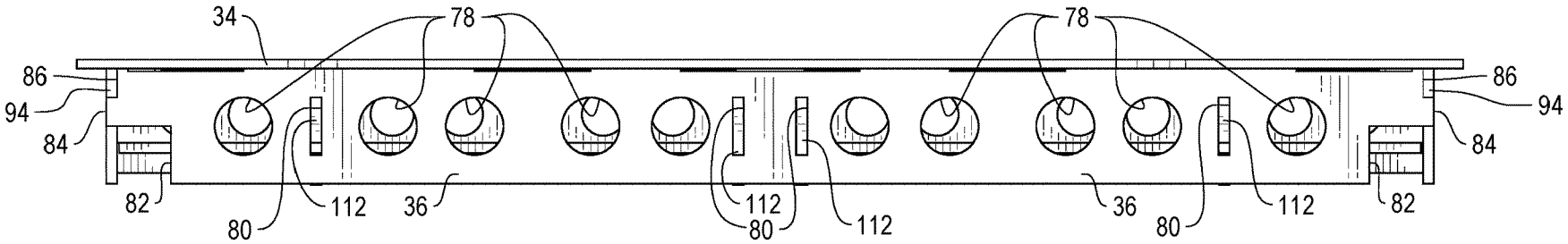
FIG. 6 is a front elevation view of the access floor panel of the embodiment of this invention illustrated in FIGS. 1-5.

As shown in FIG. 6, end support panel 36 includes spaced holes 78, slots end notches 82, end flanges 84 and end notches 86. The function of spaced holes 78 is to lighten the weight of access floor panel 30. The function of end notches 82 is to allow access floor panel 30 to be placed on a pedestal with a square head such that access floor panel 30 is flush with the rest of the access floor system. The functions of slots 80, end flanges 84 and end notches 86 are described below.

End support panel 38 has the same configuration.

Figure 7:
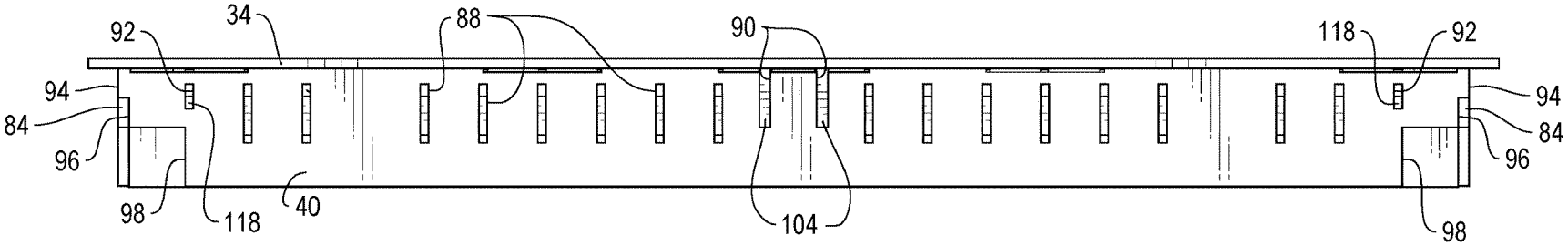
FIG. 7 is a side elevation view of the access floor panel of the embodiment of this invention illustrated in FIGS. 1-6.
Figure 8:
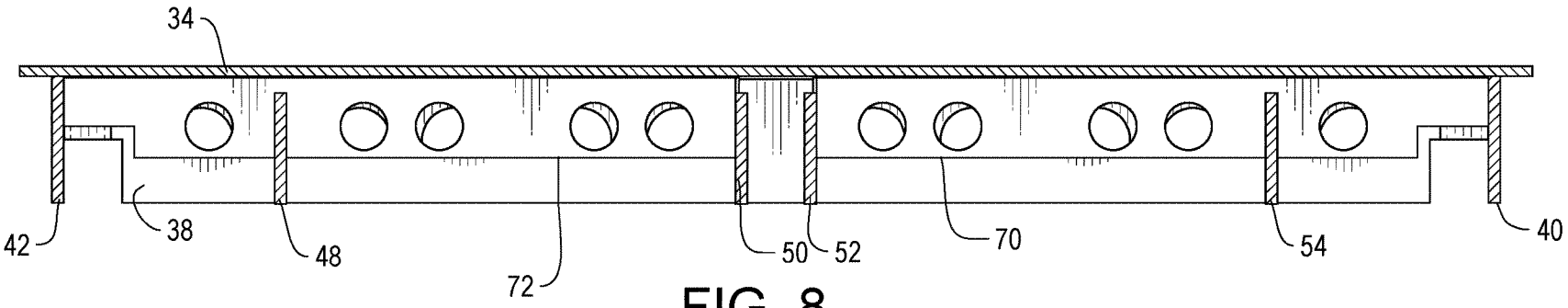
FIG. 8 is a cross sectional view of the access floor panel of the embodiment of this invention illustrated in FIGS. 1-7, taken along reference line 8-8 of FIG. 5.
Figure 9:
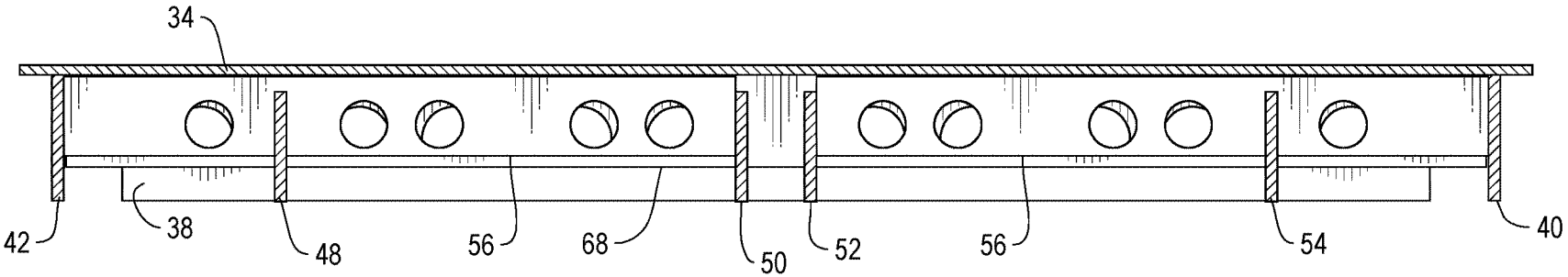
FIG. 9 is a cross sectional view of the access floor panel of the embodiment of this invention illustrated in FIGS. 1-7, taken along reference line 9-9 of FIG. 5.
Figure 10:
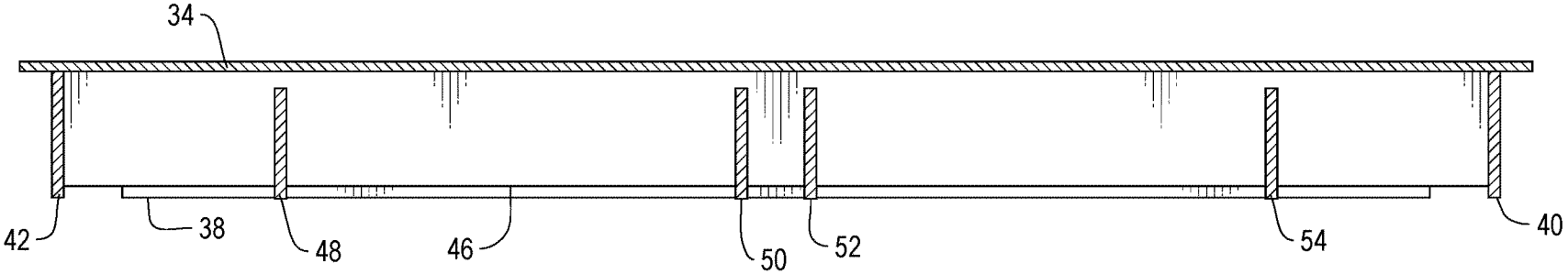
FIG. 10 is a cross sectional view of the access floor panel of the embodiment of this invention illustrated in FIGS. 1-7, taken along reference line 10-10 of FIG. 5.
Figure 11:
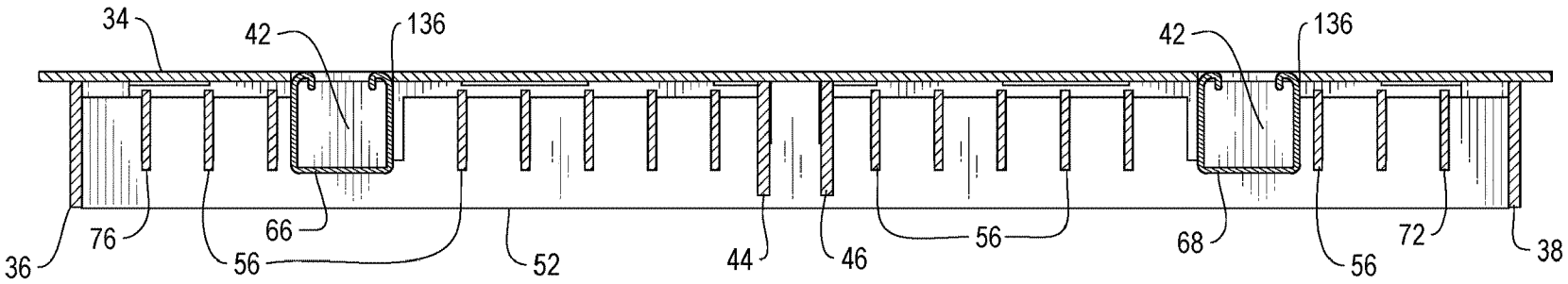
FIG. 11 is a cross sectional view of the access floor panel of the embodiment of this invention illustrated in FIGS. 1-7 taken along reference line 11-11 of FIG. 5.

As shown in FIG. 7, side support panel 40 includes elongated notches 88, 90 and 92, end flanges 94 and end notches 96 and 98. Side support panel 40 has the same configuration.

Figure 12:
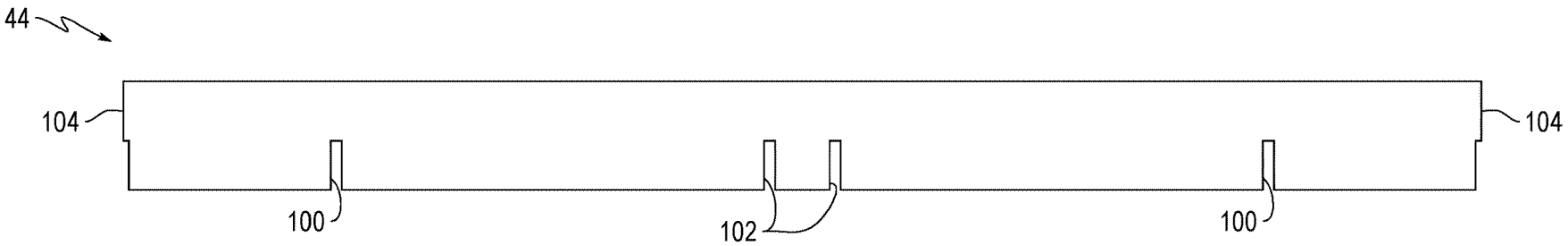
FIG. 12 is a side elevation view of an intermediate support vane of the access floor panel of the embodiment of this invention illustrated in FIGS. 1-11.

As shown in FIG. 12, intermediate support vane 44 includes notches 100 and 102 and end flanges 104. Intermediate support vane 46 has the same configuration.

Figure 13:
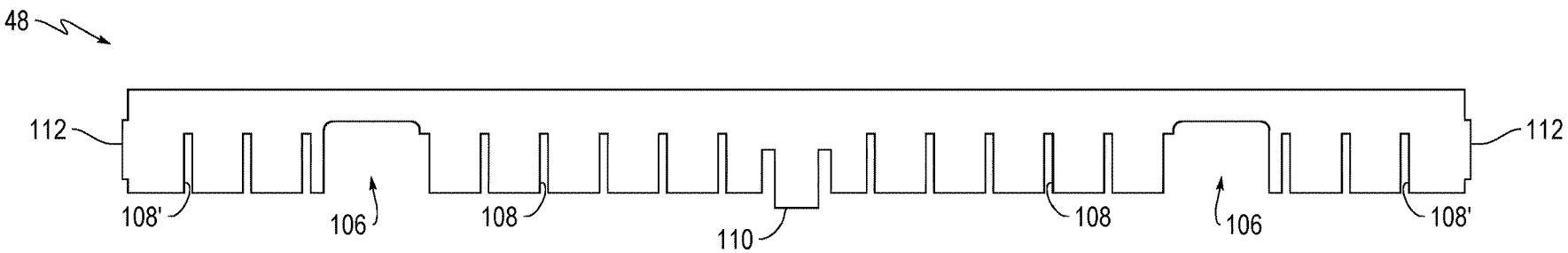
FIG. 13 is a side elevation view of another intermediate support vane of the access floor panel of the embodiment of this invention illustrated in FIGS. 1-11.

As shown in FIG. 13, intermediate support vane 48 includes troughs 106, slots 108 and 108', middle finger 110 and end flanges 112. The function of middle finger 110 is to increase the strength of access floor panel 30 at the mid-span of access floor panel 30. The functions of troughs 106, slots 108 and 108' and end flanges 112 are described below.

Intermediate support vanes 50, 52 and 54 have the same configuration.

Figure 14:
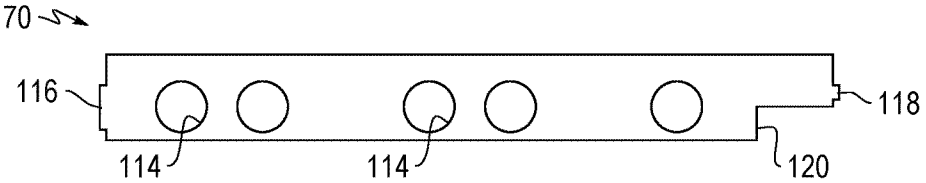
FIG. 14 is a side elevation view of yet another intermediate support vane of the access floor panel of the embodiment of this invention illustrated in FIGS. 1-11.

As shown in FIG. 14, fin support 70 has spaced holes 114, end flange 116, end flange 118 and notch 120. Fin supports 72, 74 and 76 have the same configuration.

Figure 15:
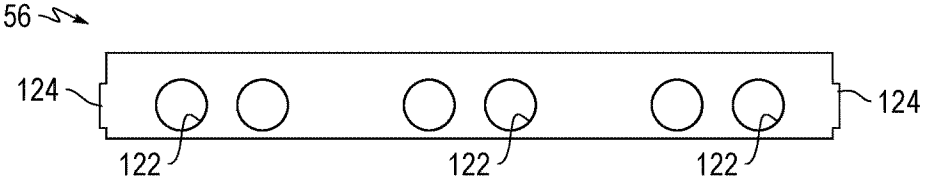
FIG. 15 is a side elevation view of yet another intermediate support vane of the access floor panel of the embodiment of this invention illustrated in FIGS. 1-11.

As shown in FIG. 15, fin supports 56 include spaced holes 122 and flanges 124.

Figure 16:
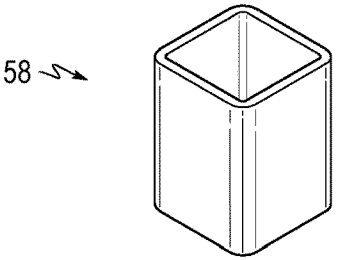
FIG. 16 is a top perspective view of a corner tube of the access floor panel of the embodiment of this invention illustrated in FIGS. 1-11.

Corner tube 58 is illustrated in FIG. 16. Corner tubes 60, 62 and 64 have the same configuration.

Figure 17:
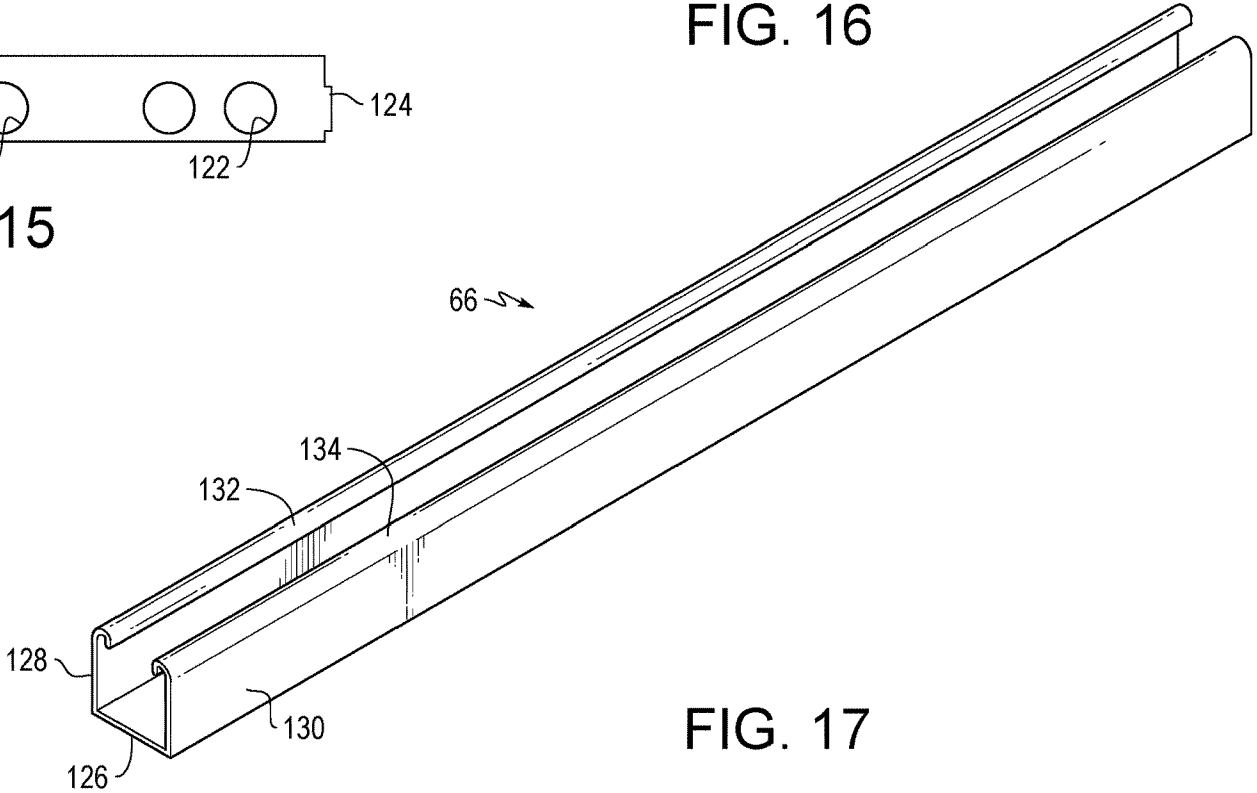
FIG. 17 is a top perspective view of a structural member of the base of the access floor panel of the embodiment of this invention illustrated in FIGS. 1-11.
Figure 18:
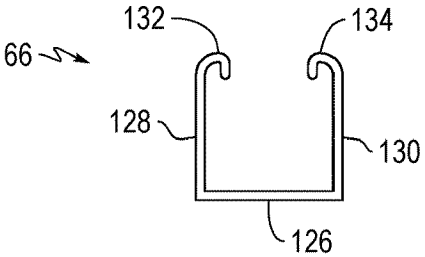
FIG. 18 is an end plan view of the structural member illustrated in FIG. 17.

As shown in FIGS. 17 and 18, channel member 66 has bottom wall 126, side walls 128 and 130 and upper hook portions 132 and 134. Side walls 128 and 130 extend upward from opposite edges of bottom wall 126. Upper hook portions 132 and 134 are continuous with side walls 128 and 130, respectively. Channel member 68 has the same configuration.

Channel members 66 and 68 define elongated slots in base 32. Specifically, bottom wall 126 defines the bottom of a slot. Side walls 128 and 130 define the side walls of the slot. The innermost edges of the upper hook portions 132 and 134 define the top opening of the slot. Each of the slots has (1) a depth in the thickness direction of access floor panel 30, from the top surface of bottom wall 126 to the top opening, (2) a longitudinal axis that is parallel to bottom wall 126 and side walls 128 and 130 and (3) the slot opening described above.

The various members of base 32, described above, are assembled as follows.

End support panels 36 and 38 and side support panels 40 and 42 are connected at their respective ends. Specifically, end flanges 94 of side support panels 40 and 42 are received in end notches 86 of end support panels 36 and 38, as shown, for example, in FIG. 6. End flanges 84 of end support panels 36 and 38 are received in end notches 96 of side support panels 40 and 42, as shown, for example, in FIG. 7. End flanges 94 are welded to end notches 86 and end flanges 84 are welded to end notches 96.

Turning to intermediate support vanes 44 and 46, end flanges 104 of intermediate support vanes 44 and 46 are received in elongated slots 90 of side support panels and 42, and welded thereto, as shown, for example, in FIG. 7.

Turning next to intermediate support vanes 48, 50, 52 and 54, end flanges 112 of intermediate support vanes 48, 50, 52 and 54 are received in elongated slots 80 of end support panels 36 and 38 and welded thereto, as shown, for example, in FIG. 6.

Considering next fin supports 70, 72, 74 and 76, flanges 118 of fin supports 72, 74 and 76 are received in elongated slots 92 of side support panels 40 and 42 and welded thereto, as shown, for example, FIG. 6. Flanges 116 of fin supports 70, 72, 74 and 76 are received in slots 108' of intermediate support vanes 50 and 52, and attached thereto. Fin supports 70, 72, 74 and 76 are also received in slots 108' of intermediate support vanes 48 and 54, and attached thereto by welding.

Turning next to support fins 56, one of each pair of flanges 124 of each support fin 56 is received in a slot 88 of one of side support panels 40 and 42 and the other of each pair of flanges 124 is received in an elongated slot 108 of intermediate support vanes 50 and 52. Support flanges 56 are also received in an elongated slot 108 of one of intermediate support vanes 48 and 54.

When base 32 is assembled, (1) intermediate support vanes 48 and 54 are received in slots 100 of intermediate support vanes 44 and 46, (2) intermediate support vanes and 52 are received in slots 102 of intermediate support vanes 44 and 46, (3) fin supports and 76 are received in slots 108' of immediate support vane 54, (4) fin supports 72 and 74 are received in slots 108' of intermediate support vane 48 and (5) fin supports 156 are received in slots 108 of intermediate support vanes 48 and 54. Intermediate support vanes 44, 46, 48, 50, 52 and 54 and fin supports 70, 72, 74, 76 and 156 are all welded together at their respective intersections.

While the base of the access floor panel of this embodiment of the invention includes, as support members, end support panels 36 and 38, side support panels 40 and 42, intermediate support vanes 44, 46, 48, 50, 52 and 54 and fin supports 70, 72, 74 and 76, the bases of the access floor panels of other embodiments of this invention may include other support members, as long as those support members provide sufficient structural integrity for the base.

Channel members 66 and 68 are received and supported by troughs 106 in intermediate support vanes 48, 50, 52 and 54. Channel members 66 and 68 are welded to (1) intermediate support vanes 48, 50, 52 and 54 at troughs 106 and (2) top sheet 34 around elongated slots 136 (described below).

While, as discussed below, this embodiment of the invention utilizes channel members 66 and 68 as members to which other structure is attached to access floor panel 30, other structural members can be used, as long as the other structure can be attached to the other structural members with sufficient integrity.

Corner tubes 58, 60, 62 and 60 are welded to end support panels 36 and 38, side support panels 40 and 42, and top sheet 34.

While the base of this embodiment of the invention includes cover tubes 58, 62 and 64 to receive fasteners, as explained below, other members can be used as long as the other members can sufficiently receive the fasteners.

Figure 3:
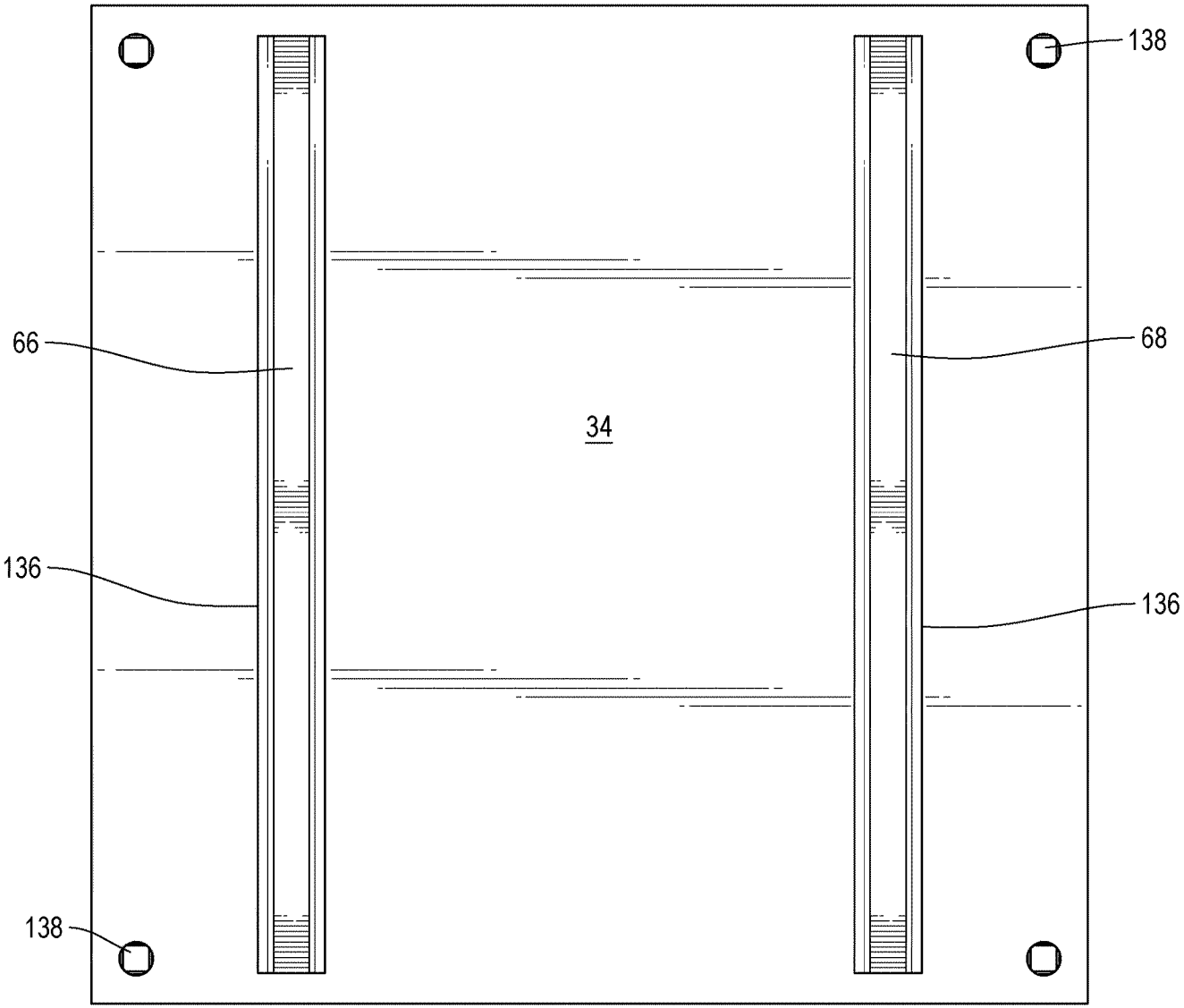
FIG. 3 is a top plan view of the access floor panel of the embodiment of this invention illustrated in FIGS. 1 and 2.
Figure 4:
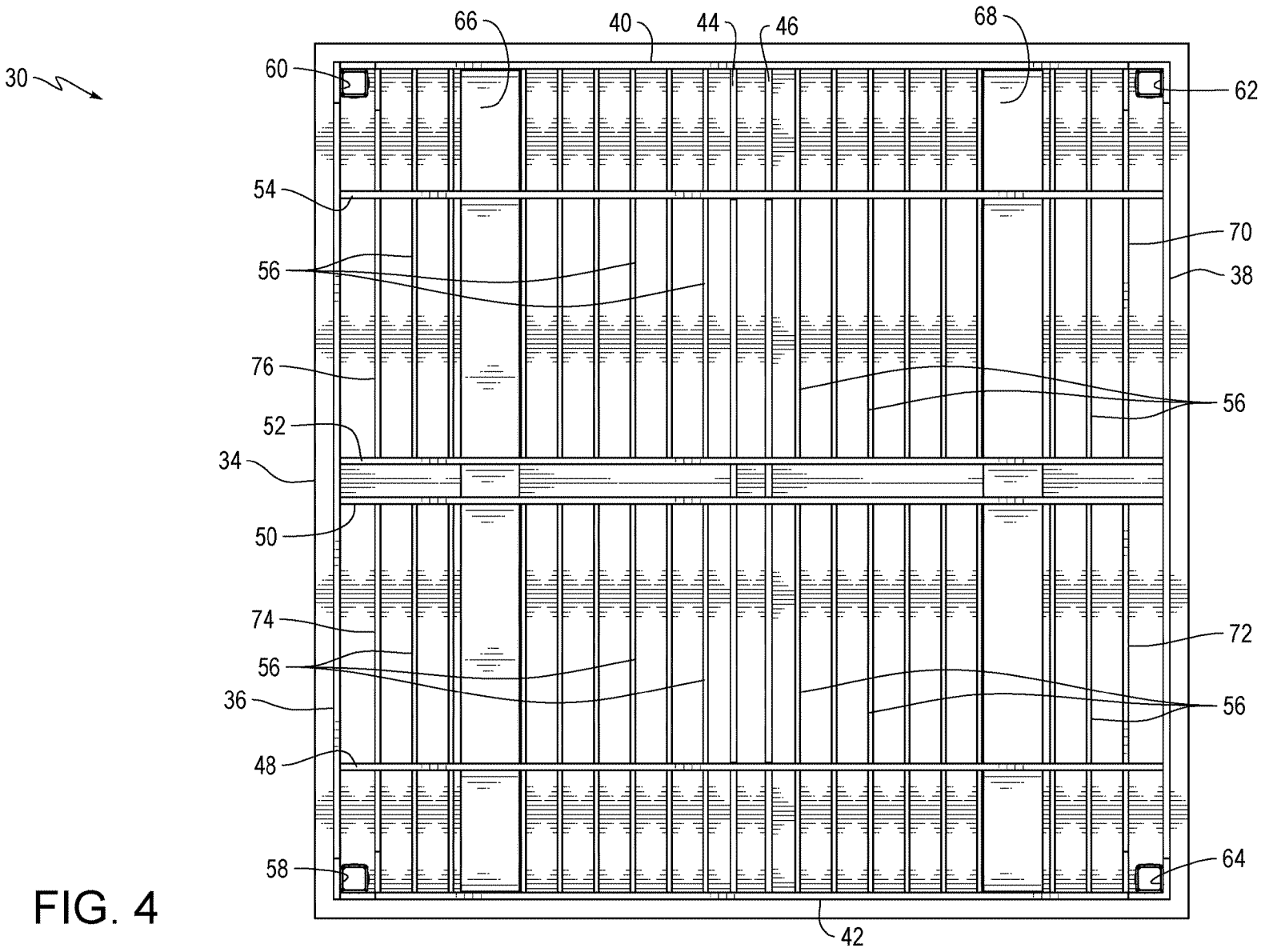
FIG. 4 is a bottom plan view of the access floor panel of the embodiment of this invention illustrated in FIGS. 1-3.
Figure 5:
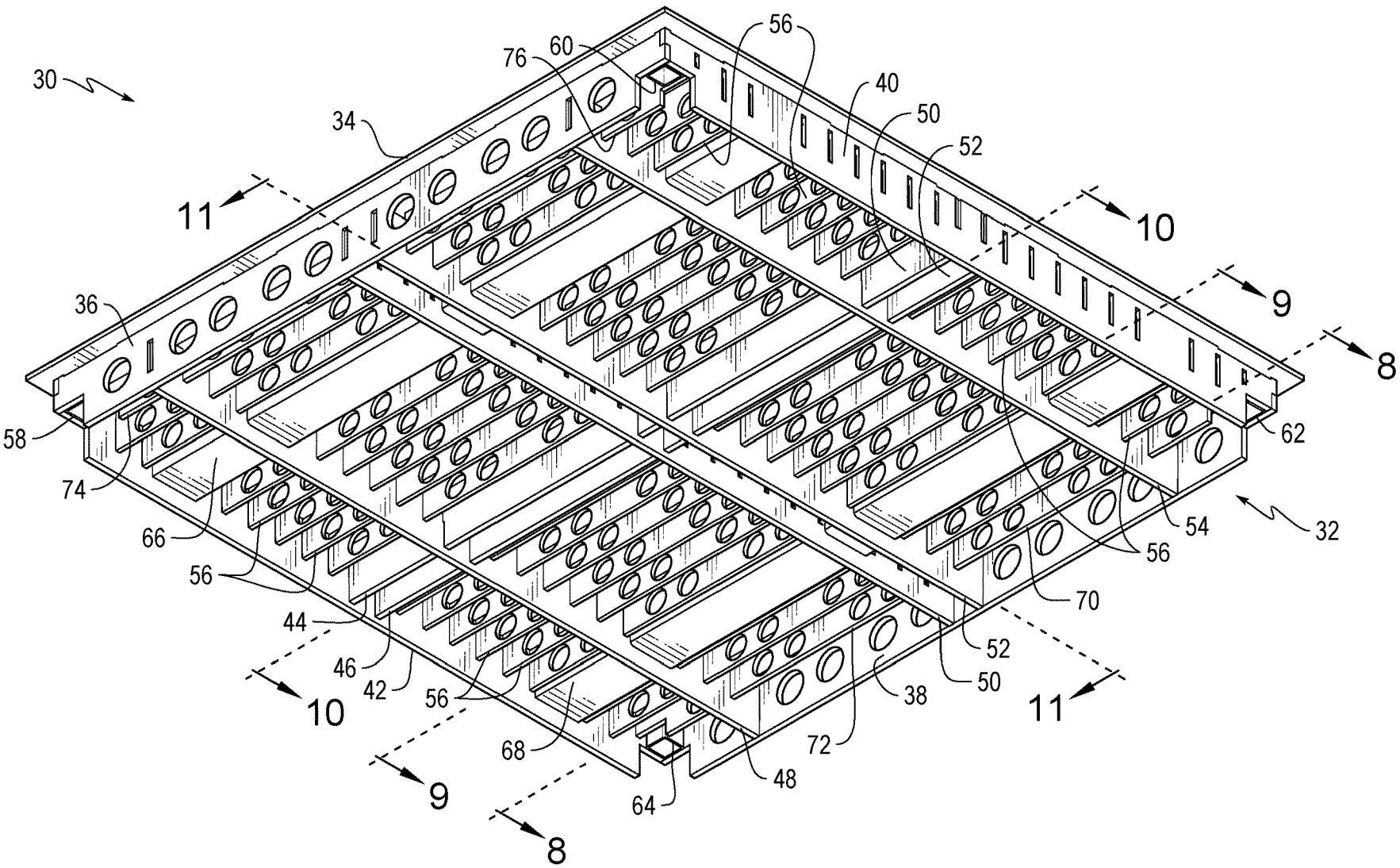
FIG. 5 is a bottom perspective view of the access floor panel of the embodiment of this invention illustrated in FIGS. 1-4.

Top sheet 34 includes parallel, elongated slots 136 and a fastener hole 138 in each corner, as shown in FIGS. 1 and 3. Top sheet 34 is attached to base 32 by welding to end support panels 36 and 38, side support panels 40 and 42 and channel members 66 and 68.

Elongated slots 136 align with channel members 66 and 68. Each fastener hole 138 is aligned with one of corner tubes 58, 60, 62 and 64.

In this embodiment of the invention, access floor panel 30 can be connected to pedestals (not shown) at all four corners. Specifically, fasteners (not shown) are inserted through fastener holes 138 in top sheet 34 and corner tubes 58, 60, 62 and 64 and attached to the pedestals.

Figure 19:
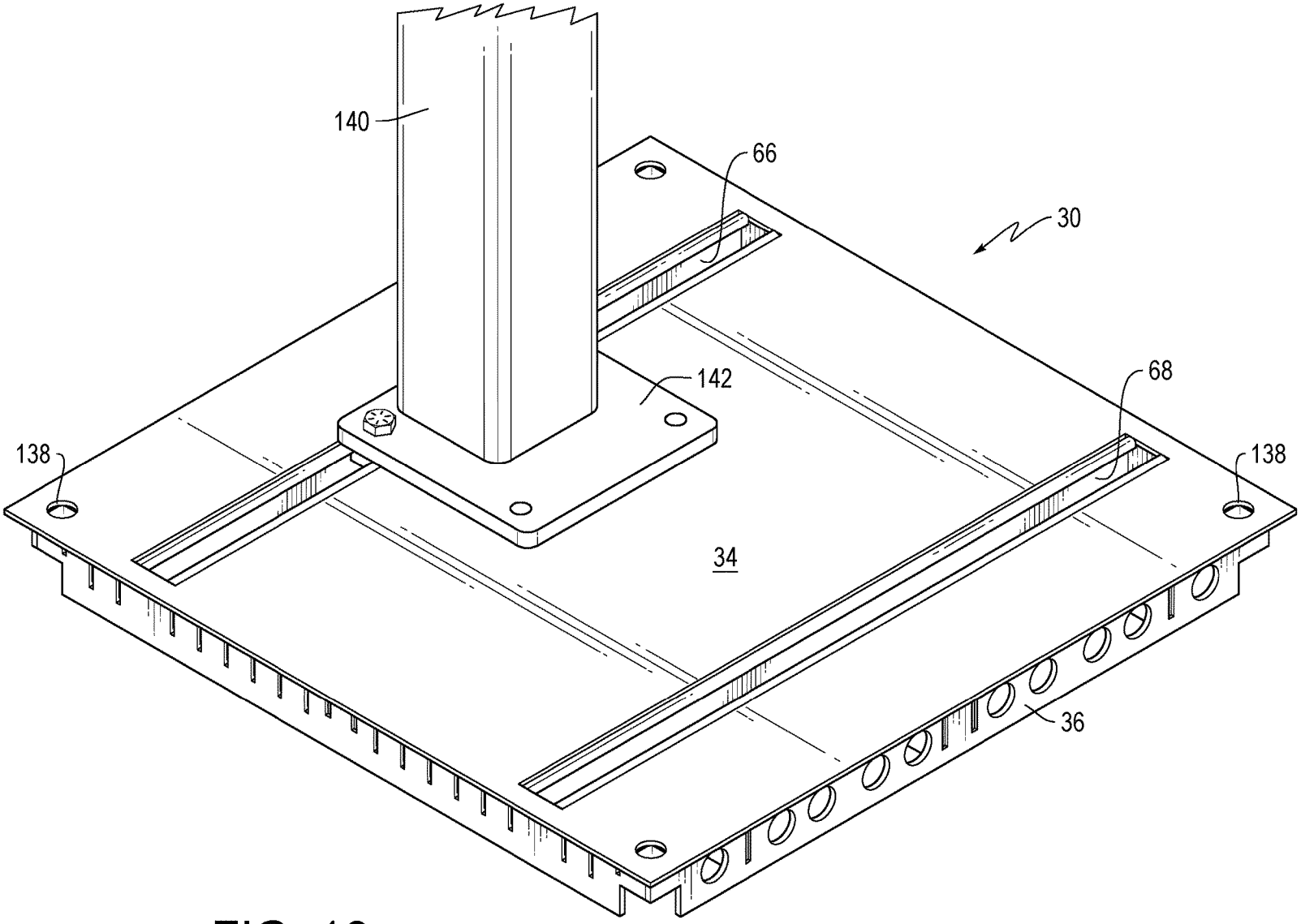
FIG. 19 is a top perspective view of the access floor panel of the embodiment of this invention illustrated in FIGS. 1-18 with a data center structural member attached thereto.
Figure 20:
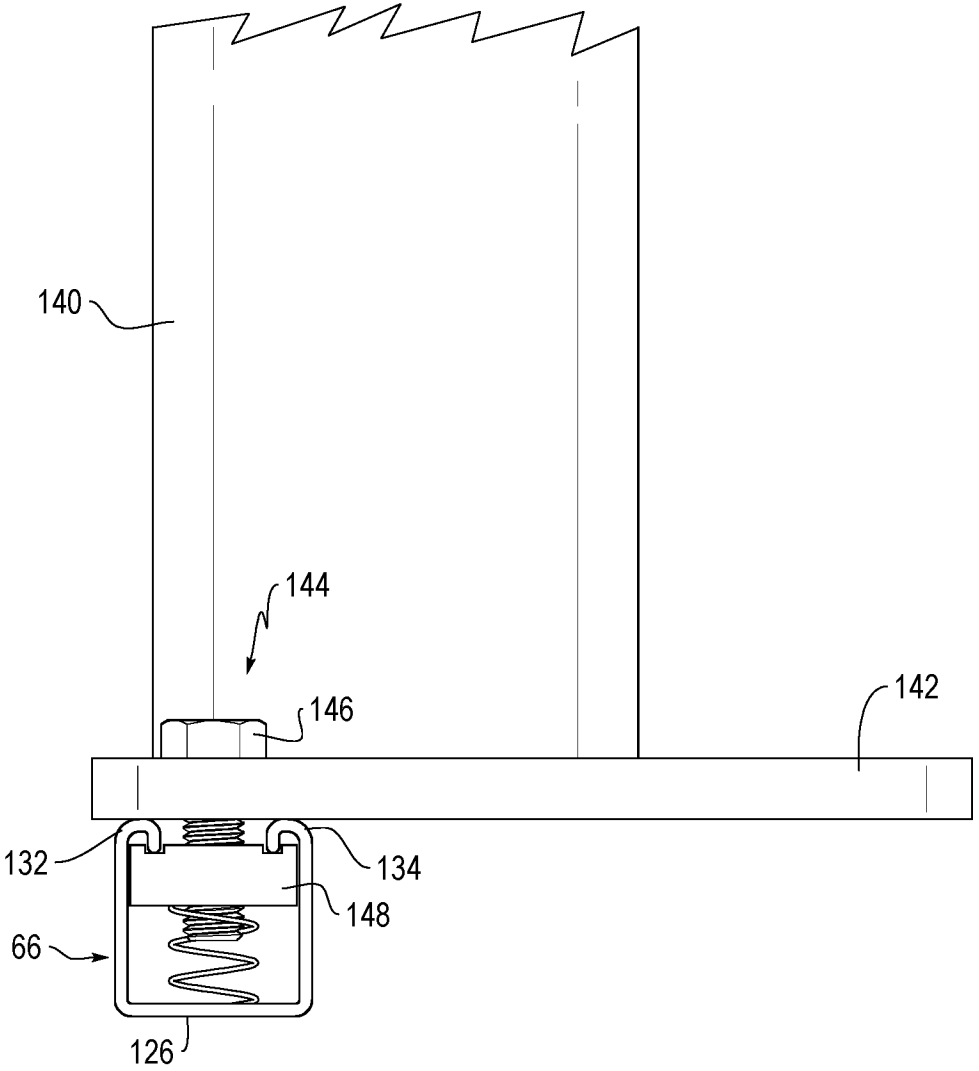
FIG. 20 is a partial, side elevation view of a portion of the access floor panel of the embodiment of this invention illustrated in FIGS. 1-18 with the structural member illustrated in FIG. 19 attached thereto.

Other structural members of, for example, a data center, can be attached to access floor panel 30, as shown in FIGS. 19 and 20 and explained next.

In FIGS. 19 and 20, post 140 and plate 142 of a data center structure are attached to access floor panel 30. Specifically, plate 142 is integral with post 140 and is attached to channel member 66 by bolt assembly 144.

More specifically, bolt assembly 144 includes bolt 146, nut 148 and spring 150. Bolt 146 is inserted through one of slots 136 of top sheet 34 and the top slot of channel member 66 defined by the innermost edges of upper hook portions 132 and 134 (discussed above). Nut 148 is screwed onto bolt 146.

Upper hook portions 132 and 134 engage the upper surface of nut 148 and maintain nut 148 within channel member 66. Spring 150 is in compression between bottom wall 126 of channel member 66 and the bottom surface of nut 148, pushing nut 148 upward against upper hook portions 132 and 134.

Any type of apparatus or structure can be attached to access floor panel 30, including, for example, in a data center, framework to support air conditioning ductwork, cable trays and aisle containment systems. Moreover, such apparatus and structure do not have to include the post/plate structure shown in FIGS. 19 and 20, as long as the apparatus or structure includes a feature that can be attached to channel members 66 and 68.

What is described and illustrated herein are preferred embodiments of the invention and variations thereof. The description and figures are intended to be for illustration only, and are not meant as limitations. Those skilled in the art will recognize that many embodiments and variations are possible within the scope of the invention, as defined by the following claims.

What is claimed is:

1. An access floor panel comprising:

a base that includes an elongated first member (a) that includes spaced longitudinal side walls and spaced inwardly extending top wall portions that extend inwardly from tops of the spaced longitudinal side walls toward each other and (b) defining a first slot having (1) a first depth in a thickness direction of the access floor panel, (2) a first longitudinal axis in a longitudinal direction that is perpendicular to the thickness direction and (3) a first slot opening formed by and between the inwardly extending top wall portions in a top of the base in the thickness direction;

a top plate (1) attached to the base on the top of the base in the thickness direction and (2) having a first top plate elongated opening that is aligned with the first slot opening of the first slot; and a fastener assembly that is received through the first top plate elongated opening and the first slot opening and affixed to the inwardly extending top wall portions to attach another member to the access floor panel.

2. An access floor panel according to claim 1, wherein the top plate includes at least one hole configured to receive a fastener to attach the access floor panel to a pedestal.

3. An access floor panel according to claim 2, wherein the at least one hole comprises a hole in each corner of the top plate.

4. An access floor panel according to claim 1, wherein each of the inwardly extending portions is hook-shaped with a curved free end of the hook-shape facing downward in the thickness direction.

5. An access floor panel according to claim 1, wherein the fastener assembly includes:

a threaded bolt received through the first slot opening and the first top plate elongated opening; and a nut that mates with the threaded bolt and that is retained within the first slot.

6. An access floor panel according to claim 5, wherein the inwardly extending portion is configured to engage the nut.

7. An access floor panel according to claim 1, wherein the top plate is permanently affixed to the base.

8. An access floor panel according to claim 1, wherein a top plate elongated opening length and a top plate elongated opening width of the first top plate elongated opening corresponds to a slot opening length and a slot opening width of the first slot opening.

9. An access floor panel according to claim 1, wherein:

the base includes an elongated second member (a) that includes second member spaced longitudinal side walls and spaced second member inwardly extending top wall portions that extend inwardly from tops of the second member spaced longitudinal side walls toward each other and (b) defining a second slot having (1) a second depth in the thickness direction of the access floor panel, (2) a second longitudinal axis in the first direction and (3) a second slot opening formed by and between the second member inwardly extending top wall portions in the top of the base in the thickness direction;

the top plate has a second top plate elongated opening that is aligned with the second slot opening; and the first slot and the second slot are spaced and parallel.

10. An access floor panel according to claim 9, wherein:

each of the the elongated first member and the elongated second member is an integral and one-piece member.

11. An access floor panel according to claim 9, wherein:

the first top plate elongated opening and the second top plate elongated opening are spaced and parallel and have the same shape and size when viewed in the thickness direction.

12. An access floor panel according to claim 9, wherein the top plate is configured such that the first top plate elongated opening and the second top plate elongated opening are uncovered when the access floor panel is in use.

13. An access floor panel according to claim 1, wherein the first slot opening extends an entire length of the elongated first member in the longitudinal direction.

14. An access floor panel according to claim 1, wherein:

the fastener assembly is a bolt assembly comprising a bolt and a nut;

the bolt passes through the first top plate elongated opening and the first slot opening; and the nut engages the inwardly extending top wall portions to affix the bolt assembly to the elongated first member.

15. An access floor panel according to claim 14, wherein the fastener assembly includes a spring between the nut and a bottom wall of the elongated first member.

16. An access floor panel according to claim 1, wherein the elongated first member is an integral, one-piece member.

* * * * *